US007574883B2

(12) United States Patent
Grampurohit

(10) Patent No.: US 7,574,883 B2
(45) Date of Patent: Aug. 18, 2009

(54) LOCK CYLINDER

(75) Inventor: Mahesh V. Grampurohit, Hubli (IN)

(73) Assignee: Schlage Lock Company, Carmel, IN (US)

( * ) Notice: Subject to any disclaimer, the term of this patent is extended or adjusted under 35 U.S.C. 154(b) by 0 days.

(21) Appl. No.: 11/743,772

(22) Filed: May 3, 2007

(65) Prior Publication Data

US 2008/0271506 A1 Nov. 6, 2008

(51) Int. Cl.
*E05B 27/00* (2006.01)

(52) U.S. Cl. ..... 70/493; 70/378; 70/384; 70/494

(58) Field of Classification Search ..... 70/378, 70/409, 492–496, 384
See application file for complete search history.

(56) References Cited

U.S. PATENT DOCUMENTS

| | | | | | |
|---|---|---|---|---|---|
| 3,059,462 | A | | 10/1962 | Check | |
| 3,099,151 | A | | 7/1963 | Schlage | |
| 3,431,757 | A | | 3/1969 | Hori | |
| 3,499,302 | A | * | 3/1970 | Flora et al. | 70/494 |
| 3,722,240 | A | * | 3/1973 | Spain et al. | 70/494 |
| RE30,198 | E | * | 1/1980 | Oliver et al. | 70/494 |
| 4,235,086 | A | | 11/1980 | Genakis | |
| 4,450,699 | A | | 5/1984 | Genakis | |
| 4,732,022 | A | * | 3/1988 | Oliver | 70/406 |
| 4,875,352 | A | | 10/1989 | Smallegan et al. | |
| 4,932,229 | A | * | 6/1990 | Genakis | 70/494 |
| 5,209,087 | A | * | 5/1993 | Cox | 70/369 |
| 5,375,444 | A | * | 12/1994 | Smith | 70/495 |
| 5,517,840 | A | * | 5/1996 | Haggstrom | 70/495 |
| 5,570,601 | A | * | 11/1996 | Field | 70/409 |
| 5,582,050 | A | * | 12/1996 | Haggstrom | 70/495 |
| 5,640,865 | A | * | 6/1997 | Widen | 70/495 |
| 5,715,717 | A | * | 2/1998 | Widen | 70/493 |
| 5,809,816 | A | * | 9/1998 | Widen | 70/493 |
| 5,943,890 | A | * | 8/1999 | Field et al. | 70/493 |
| 6,675,617 | B2 | | 1/2004 | Stemmerik | |
| 6,823,702 | B2 | * | 11/2004 | Haggstrom | 70/358 |
| 7,159,424 | B2 | * | 1/2007 | Widen | 70/409 |
| 7,272,965 | B2 | * | 9/2007 | Dolev | 70/276 |
| 2005/0022568 | A1 | | 2/2005 | Dolev | |
| 2006/0207304 | A1 | * | 9/2006 | Widen | 70/494 |
| 2008/0202180 | A1 | * | 8/2008 | Eller et al. | 70/493 |

FOREIGN PATENT DOCUMENTS

| | | | |
|---|---|---|---|
| DE | 10333211 | A1 | 3/2005 |
| DE | 102005001085 | A1 | 7/2006 |
| WO | 2004/029390 | A1 | 4/2004 |

* cited by examiner

*Primary Examiner*—Suzanne D Barrett
(74) *Attorney, Agent, or Firm*—Michael Best & Friedrich LLP

(57) ABSTRACT

A lock cylinder that includes a housing defining a cylindrical cavity, and a plug disposed in the cylindrical cavity and rotatable between a locked position and an unlocked position. The plug includes a key slot and an inner pin chamber aligned with an outer pin chamber of the housing when the plug is in the locked position. An inner pin is disposed in the inner pin chamber for movement along an axis, and is engageable with the outer pin when the plug is in the locked position. The inner pin is engageable by a key inserted into the key slot, and includes an outer surface that defines a non-axial groove. An engagement member is supported by the plug and extends into the groove.

27 Claims, 3 Drawing Sheets

LOCK CYLINDER

BACKGROUND

The present invention relates to a lock cylinder. More particularly, the present invention relates to a lock cylinder that includes a housing and a plug.

Generally, lock cylinders include a housing and a plug that define respective pin chambers to receive pin pairs. The pin pairs include outer pins substantially disposed within the housing, and inner pins disposed within the plug. Springs are often used to bias the pin pairs toward a key slot in the plug. More specifically, the springs are engaged with the outer pins, which in turn engage the inner pins and force the inner pins into the key slot. In the absence of a correct or appropriate key, the outer pins are partially disposed in the plug and block rotation of the plug within the housing.

The plug is rotatable relative to the housing in most conventional lock cylinders. A shear line is defined where the plug and the housing come together. When an appropriate key is inserted into the key slot, the inner and outer pins are moved. The junctions of the inner pins and the outer pins are aligned with the shear line, which allows the plug to be turned to a locked or unlocked position. In other words, the appropriate key will move the inner and outer pins such that the outer pins are disposed completely in the housing, and the inner pins are disposed completely in the plug.

SUMMARY

In one embodiment, the invention provides a lock cylinder that includes a housing and a plug. The housing defines a cylindrical cavity and an outer pin chamber that is adapted to house an outer pin. The plug is disposed in the cavity and is rotatable between a locked position and an unlocked position, and includes an inner pin chamber that is aligned with the outer pin chamber when the plug is in the locked position. A key slot is disposed at least partially through the plug, and is in communication with the inner pin chamber. The lock cylinder further includes an inner pin positioned in the inner pin chamber for movement along an axis and engageable with a key inserted into the key slot. The inner pin is also engageable with the outer pin when the plug is in the locked position, and includes an outer surface that defines a non-axial groove. The lock cylinder also includes an engagement member that is supported by the plug and that extends into the groove.

In another embodiment, the invention provides a lock cylinder that includes a housing and a plug. The housing defines a cylindrical cavity and an outer pin chamber that is adapted to house an outer pin. The plug is rotatably disposed in the cavity, and includes an inner pin chamber selectively aligned with the outer pin chamber. A key slot is disposed at least partially through the plug. The lock cylinder also includes an inner pin disposed within the inner pin chamber, and an engagement member disposed within the plug and engaged with the inner pin to allow relatively slow movement of the inner pin, and to resist relatively quick movement of the inner pin.

In yet another embodiment, the invention provides a method of operating a lock cylinder. The method includes providing a housing that defines a cylindrical cavity and includes an outer pin, and providing a plug that is rotatable within the cavity and includes a key slot and an inner pin selectively aligned with the outer pin. The method further includes engaging an engagement member with the inner pin without engagement of the engagement member with the outer pin, allowing relatively slow movement of the inner pin, and resisting relatively quick movement of the inner pin.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Figure 1:
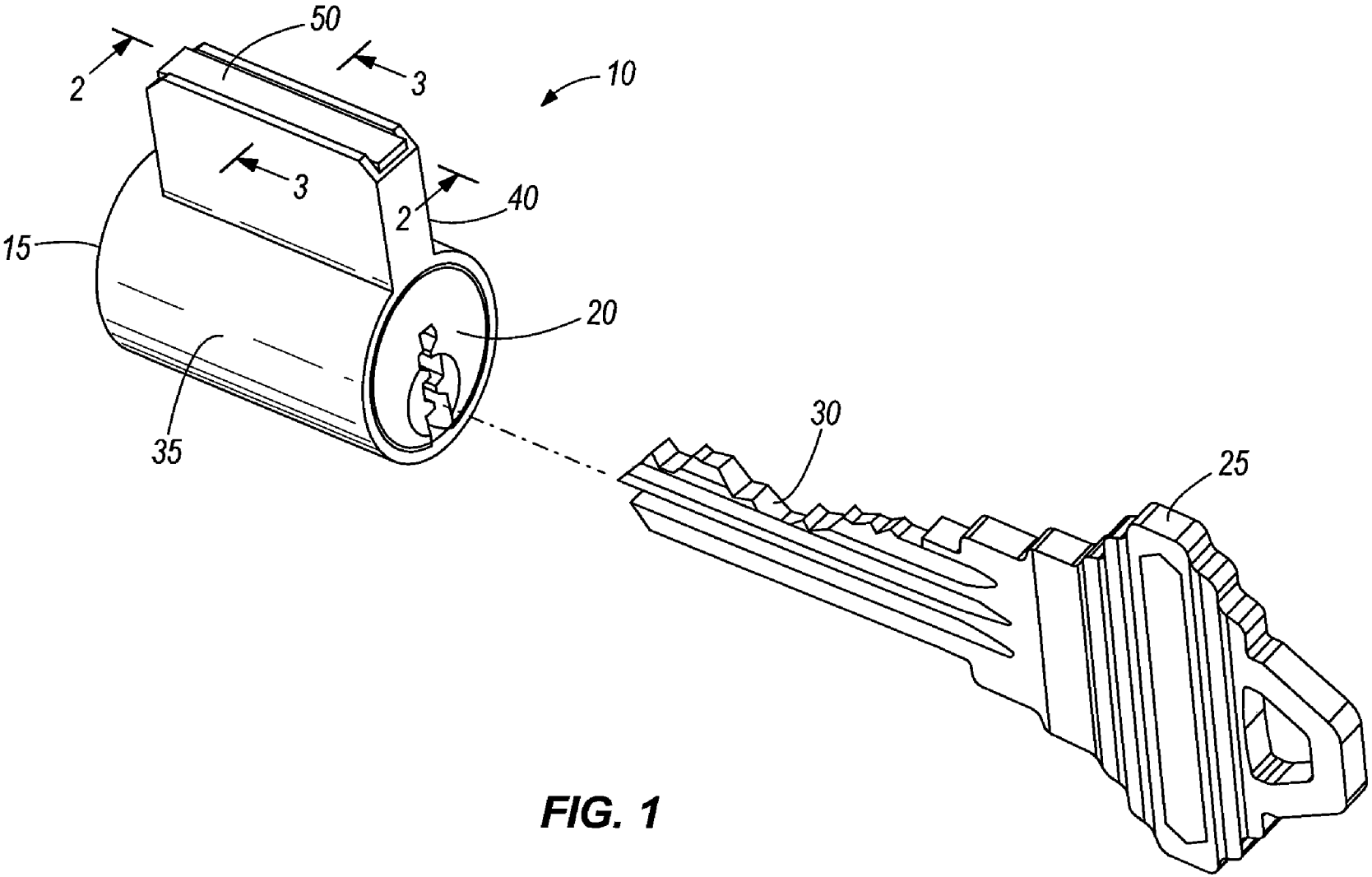
FIG. 1 is a perspective view of an exemplary lock cylinder of the present invention.

FIG. 1 shows a lock cylinder 10 for use with structures (e.g., doors, access panels, portable locks, etc.) that may be locked and unlocked. Hereinafter, the term "door" shall be used to represent all such lockable structures and shall not be construed to limit the invention's application solely to doors. The lock cylinder 10 includes a housing 15 and a plug 20 configured to be selectively rotatable within the housing 15 using a key 25 that has pin engaging portions 30.

Figure 3:
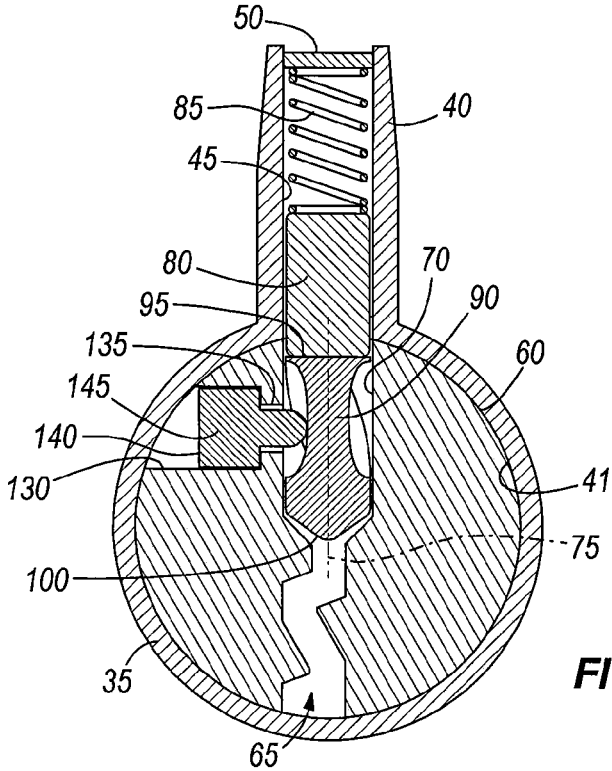
FIG. 3 is a cross-section view of the plug taken along line 3-3 of FIG. 1.

The housing 15 is typically fixed relative to the door, and includes a wall 35 and a pin portion 40. As shown in FIG. 3, the wall 35 is substantially cylindrical and has an interior surface that defines a cylindrical cavity or hollow portion 41 configured to receive the plug 20.

Figure 2:
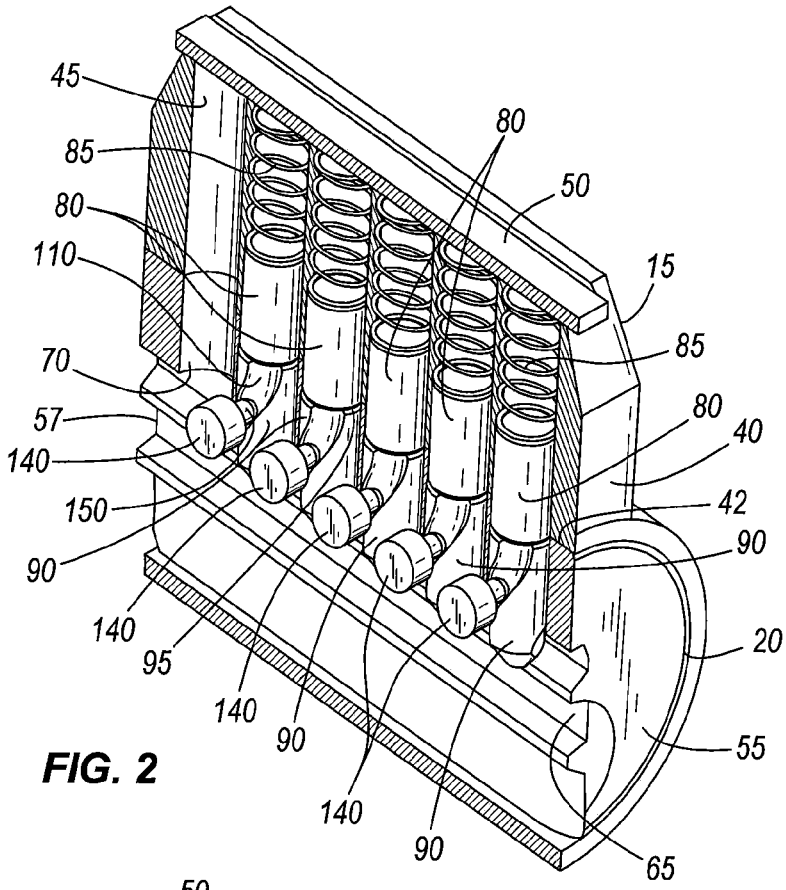
FIG. 2 is a sectional view of a portion of the lock cylinder taken along line 2-2 of FIG. 1, and including inner pins, outer pins, and engagement members.

The housing 15 is typically fixed relative to the door, and the plug 20 is movable or rotatable relative to the housing 15 between a locked position (FIGS. 1-3) and an unlocked position (not shown). As shown in FIG. 2, the housing 15 and the plug 20 cooperate to define a shear line 42 after insertion of the plug 20 into the housing 15. The plug 20 is typically connected to a driver bar (not shown) or other structure for moving a latch (not shown) relative to the door to lock or unlock the door. Such arrangements are well known in the art.

FIGS. 2 and 3 show that the pin portion 40 extends above the wall 35 and includes first or outer pin chambers 45. The outer pin chambers 45 are accessible through a removable member 50 adjacent the outer end of the pin portion 40, and are in communication with the cylindrical cavity 41. In the construction illustrated in FIG. 2, the pin portion 40 includes six outer pin chambers 45, but fewer or more outer pin chambers 45 are within the scope of the invention.

The plug 20 includes a first or outer end 55, a second or inner end 57 opposite the first end 55, a generally cylindrical outer surface 60, and a key slot 65. The first end 55 is accessible from the front of the lock cylinder 10, and the second end 57 is accessible from the rear of the lock cylinder 10. The key slot 65 extends longitudinally through the plug 20 from the first end 55 toward the second end 57. The key 25 is insertable into the key slot 65 at the first end 55.

The plug 20 also includes second or inner pin chambers 70 that extend substantially transverse to the key slot 65 from the outer surface 60. Each inner pin chamber 70 has an axis 75 (FIG. 3), and is in communication with the key slot 65. As shown in FIG. 3, each inner pin chamber 70 is selectively aligned with a respective outer pin chamber 45 along the axis 75 when the plug 20 is in the locked position. In the illustrated construction, the plug 20 includes six inner pin chambers 70 (FIG. 2), but fewer or more inner pin chambers 70 are within the scope of the invention.

FIG. 2 shows that the pin portion 40 further includes a first or outer pin 80 disposed within five of the six outer pin chambers 45. The reason for only five outer pins 80 is explained below. The outer pins 80 are configured to move in a first or inward direction into the plug 20, and in a second or outward direction away from the plug 20. As shown in FIG. 3, the outer pins 80 extend partially into the respective inner chambers 70 when the plug 20 is in the locked position and the key 25 is not inserted into the key slot 65. The pin portion 40 further includes springs 85 to bias the outer pins 80 inward. In other embodiments, the outer pins 80 may tend to move inward without the springs 85 due to orientation of the pin portion 40 above the plug 20 (i.e., inward movement assisted by gravity).

FIG. 2 shows a respective second or inner pin 90 disposed within five of the six inner pin chambers 70 configured for movement along the axis 75. As illustrated in FIGS. 2 and 3, each inner pin 90 is generally engaged with a respective outer pin 80 when the plug 20 is in the locked position. Each inner pin-outer pin combination defines a parting line 95 (FIG. 3) that aligns with the shear line 42 when an appropriate key is inserted into the key slot 65. In some embodiments, the inner pins 90 can be formed from a nickel-silver material. In other embodiments, the inner pins 90 can be formed from stainless steel material. In still other embodiments, the inner pins 90 may be formed from other materials.

Figure 4:
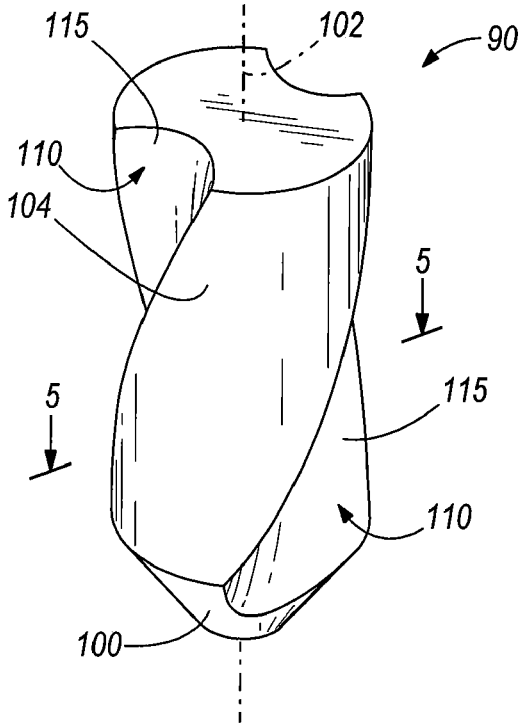
FIG. 4 is a perspective view of one of the inner pins of FIG. 2.
Figure 6:
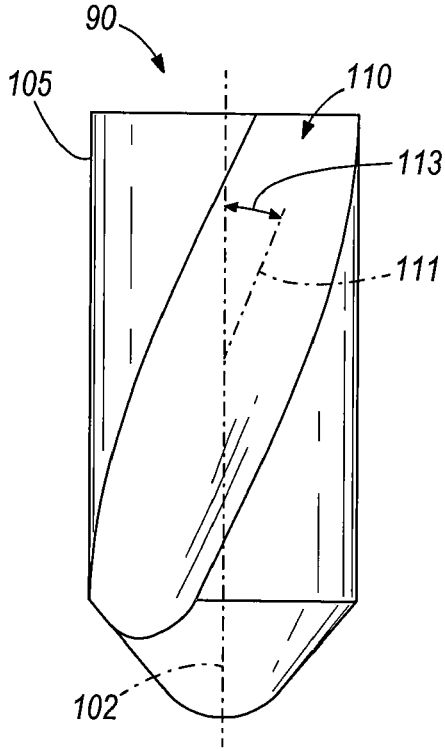
FIG. 6 is a side view of the inner pin of FIG. 4.

FIGS. 3 and 4 show that each inner pin 90 includes an inner end 100 that extends into the key slot 65 for selective engagement by the key 25. FIG. 6 shows that each pin 90 has an axis 102 that extends along a vertical centerline of the inner pin 90. The axis 102 is substantially aligned with the axis 75 when the inner pin 90 is inserted into the inner pin chamber 70.

In the construction of the lock cylinder 10 illustrated in FIG. 2, the pin portion 40 includes five outer pins 80 and five inner pins 90 positioned in respective outer and inner pin chambers 45, 70. Generally, the quantity of inner pins 90 will be the same as the quantity of outer pins 80. More or fewer outer pins 80 and inner pins 90 may be possible and are within the scope of the invention. For example, commercial applications of the lock cylinder 10 generally include six outer and inner pins 80, 90, respectively, in accordance with established industry practices. However, residential applications of the lock cylinder 10 usually have settled on five or fewer outer and inner pins 80, 90, respectively. In these residential applications, the plug 20 may include five outer pins 80 and inner pins 90 in five corresponding outer and inner pin chambers 45, 70, even though the plug 20 may have six or more outer and inner pin chambers 45, 70 (see FIG. 2). The remaining outer and inner pin chambers 45, 70 may be unused in residential applications. The invention described herein incorporates both commercial and residential applications of the lock cylinder 10, and should not be limited to only one such application.

Figure 5:
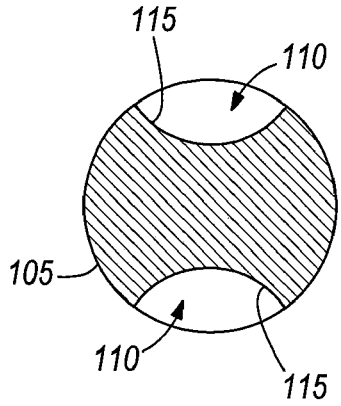
FIG. 5 is a section view of the inner pin taken along line 5-5 of FIG. 4.

FIGS. 4 and 5 show that each inner pin 90 includes a cylindrical outer surface 105 having non-axial grooves 110 extending along a substantial length of each inner pin 90. Each groove 110 has a spiral-like, preferably helical shape, and is defined by a curved surface 115 that has a substantially semi-circular cross section defining side walls of the groove 110. Other constructions of the non-axial groove 110 are also possible (e.g., planar, angled surfaces with a substantially triangular cross-section, etc.). The illustrated construction of the inner pin 90 shows that the inner pin 90 includes two non-axial grooves 110. However, other constructions of the inner pin 90 may include one groove 110.

FIG. 6 shows one non-axial groove 110 spiraling generally upward along the inner pin 90 from left to right. The non-axial groove 110 has an axis 111 that defines an angle of incline 113 with respect to the axis 102. The non-axial groove 110 is formed on the outer surface 105 such that the groove 110 crosses or intersects a vertical plane defined by the axis 102. In other words, the groove is not parallel to the axis 102. Generally, the angle of incline 113 is greater than a self-locking angle of the non-axial groove 110 for an inner pin 90 formed from a particular material. In other words, the coefficient of friction for a particular material of the inner pin 90 must be greater than the trigonometric function defined by the tangent of the angle of incline 113 (i.e., the lead angle). In the construction illustrated in FIG. 6, the angle of incline 113 is about 35 degrees with respect to the axis 102. In other constructions, the angle of incline 113 can be between about 15 degrees and about 55 degrees relative to the axis 102. In still other embodiments, other angles for the angle of incline 113 are possible.

FIG. 3 shows that the plug 20 also includes bores or passageways 130 in communication with respective inner pin chambers 70. In some constructions, the plug 20 may include a passageway 130 for each inner pin chamber 70. In other constructions, the plug 20 may include a passageway 130 for fewer than each inner pin chamber 70. Each passageway 130 extends into the plug 20 substantially transverse or orthogonal to the inner pin chambers 45 and to the key slot 65. Each passageway 130 further extends between the outer surface 60 and a respective inner pin chamber 70. The passageway 130 illustrated in FIG. 3 extends generally horizontally into the plug 20 when the plug is in the locked position, and includes a stop member or shoulder or protrusion 135 adjacent its inner end. In some constructions, the stop member 135 may be formed by a machining or milling process. In other constructions, the stop member 135 may be formed by a casting process.

The lock cylinder 10 also includes one or more engagement members 140 housed in respective passageways 130. FIG. 2 shows five engagement members 140, but there can be fewer or more engagement members 140 than inner pins 90. In some embodiments, the engagement members 140 can be formed from brass material. In other embodiments, the engagement members 140 may be formed from other materials.

FIG. 3 shows one engagement member 140 positioned in a respective passageway 130. The stop member 135 limits inward movement of the engagement member 140 into the inner pin chamber 70, and outward movement of the engagement member 140 is inhibited by the wall 35 when the plug 20 is inserted into the housing 15. In other words, when the plug 20 is inserted into the housing 15, the engagement member 140 is substantially immovable inward due to engagement of the engagement member 140 with the stop member 135, and is further substantially immovable outward due to engagement with the housing 15. When the plug 20 is not in the housing 15, the engagement member 140 can be inserted and removed from the passageway 130.

Figure 7:
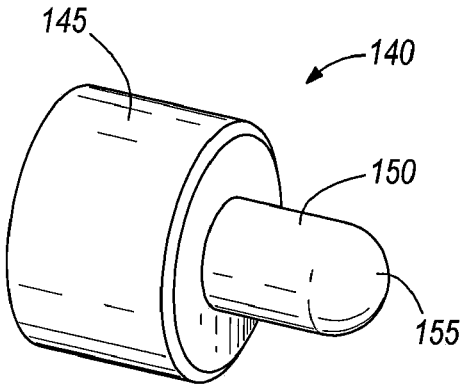
FIG. 7 is a perspective view of an engagement member of FIG. 2.

As shown in FIG. 3, the engagement member 140 rests against the stop member 135 when the engagement member 140 is inserted into the passageway 130. FIG. 7 shows that the engagement member 140 includes a cylindrical body 145 and an inner end or engagement portion 150 extending from the cylindrical body 145 into the inner pin chamber 70. The engagement portion 150 includes a substantially semispherical end portion 155 defining a surface that has a curvature substantially corresponding to the curvature of the curved surface 115. When the inner pin 90 is positioned in the inner pin chamber 70, the end portion 155 extends into the groove 110 and is engageable with the curved surface 115.

The lock cylinder 10 is assembled by inserting the plug 20 into the housing 15 after the inner pins 90 and the engagement members 140 have been positioned in the plug 20. The plug 20 is assembled by inserting the engagement members 140 into the passageways 130, and then inserting the inner pins 90 into the inner pin chambers 70. Each inner pin 90 is aligned within the inner pin chamber 70 such that the engagement portion 150 of the respective engagement member 140 is disposed within the groove 110 and engageable with the curved surface 115. The outer pins 80 are positioned in the outer pin chambers 45 after the plug 20 has been assembled and inserted into the housing 15. In embodiments that include the springs 85, the springs 85 are inserted into the pin portion 40 after insertion of the outer pins 80. The removable member 50 is positioned over the outer pin chambers 45 after insertion of the outer pins 80.

In operation, the springs 85 bias the outer pins 80 and the inner pins 90 inward such that the outer pins 80 partially extend into the inner pin chambers 70 without a proper or appropriate key 25 in the key slot 65. The inner pins 90 are in communication with the key slot 65 for selective engagement by a key 25 inserted into the key slot 65. The engagement members 140 are not directly engaged by the key 25 when the key 25 is inserted into the key slot 65. In embodiments that do not include the springs 85, the outer pins 80 move inward under the force of gravity.

The engagement members 140 extend into the non-axial grooves 110 to selectively allow movement of the inner pins 90 toward the outer pins 80. More specifically, each engagement member 140 and corresponding non-axial groove 110 cooperate to allow relatively slow movement of the corresponding inner pin 90, and cooperate to resist relatively quick movement of the inner pin 90.

Relatively slow movement of the inner pins 90 is generally defined as deliberate or uniform movement that can be facilitated by insertion of an appropriate key 25 into the key slot 65. When the appropriate key 25 is inserted into the plug 20, the pin engaging portions 30 are engaged with the end 100 of each inner pin 90. The inner pins 90 are slowly moved outward generally along the axis 75 by the key 25, and engage and move the outer pins 80. As each inner pin 90 is moved upward by the key 25, the engagement member 140 causes a respective inner pin 90 to rotate. Each inner pin 90 rotates due to the respective semispherical end portion 155 following the path defined by the non-axial groove 110. Each inner pin 90 rotates about the axis 75 in response to movement of the inner pin 90 outward along the axis 75 due to the engagement member 140 extending into the non-axial groove 110. The shape of the non-axial groove 110 generally defines the rotation of the inner pin 90. The inner pins 90 engage the outer pins 80 to align the parting lines 95 with the shear line 42 such that the plug 20 can be rotated to the unlocked position.

Relatively quick movement of the inner pins 90 is generally defined by an atypical jamming or bumping movement that attempts to move the outer pins 80 out of the inner pin chambers 70 in an attempt to rotate the plug 20 to the unlocked position without using an appropriate key 25. In a conventional lock, relatively quick movement of the inner pins 90 could be caused by bumping the inner pins with an improper or inappropriate key (not shown) in an attempt to pick the lock. In the lock cylinder 10, the spherical end portions 155 of the locking members 140 limit or resist movement of the inner pins 90 along the axis 75 when the inner pins 90 are bumped. The end portion 155 engages the sidewalls of the curved surface 115 due to the force exerted on the inner pin 90, causing friction or resistance between the curved surface 115 and the end portion 155. The friction or resistance caused by bumping the inner pin 90 substantially limits linear and rotational movement of the inner pin 90, and inhibits outward movement of the inner pin 90 toward the outer pin 80. As a result, relatively quick movement of the inner pin 90 is inhibited, the outer pin 80 remains partially disposed in the inner pin chamber 70, and the plug 20 cannot be rotated to the unlocked position.

The lock cylinder 10 described above and illustrated in FIGS. 1-7 show a particular shape of the non-axial grooves 110 (e.g., helical about the inner pins 90, substantially semicircular cross-section, angle of incline 113, etc.) and the shape of the engagement members 140 (e.g., spherical end portions 155, etc.). However, as known and understood by one ordinary skill in the art, many variations of the shape of the non-axial grooves 110 and the engagement members 140 are possible and within the scope of the invention. As such, the shape of the non-axial grooves 110 and the shape of the engagement members 140 should not be limited to the embodiments discussed above or shown in FIGS. 1-7.

In addition, the materials discussed above with regard to the inner pins 90 and the engagement members 140 are only exemplary, and shall not be limited. One of ordinary skill in the art will recognize and understand that many variations of the material for the inner pins 90 and the material for the engagement members 140 are possible. In addition, one of ordinary skill in the art will appreciate that some materials can interact with other materials in different ways, such as increasing or decreasing friction between the inner pins 90 and the engagement members 140.

The material of the engagement members 140 interacts with the material of the inner pins 90 to define a coefficient of friction between the materials of the end portions 155 and the curved surfaces 115. The coefficient of friction is indicative of the amount of resistance between the materials of the respective end portions 155 and the curved surfaces 115. A higher coefficient of friction between the materials defining the end portion 155 and the curved surface 115 results in a larger resistance by the inner pin 90 to movement in the outward direction toward the outer pin 80. A lower coefficient of friction between the materials of the end portion 155 and the curved surface 115 results in smaller resistance by the inner pin 90 to movement in the outward direction toward the outer pin 80.

As one of ordinary skill in the art will appreciate and understand, the scope of the present invention considers that operation of the lock cylinder 10 as described above is dependent on, among other things, various features or characteristics of the inner pins 90 and the engagement members 140. These characteristics include, but are not limited to, the size and shape of the engagement members 140 relative to the size and shape of the non-axial grooves 110, and the material selected for the inner pins 90 and the material selected for the engagement members 140.

Various features and advantages of the invention are set forth in the following claims.

What is claimed is:

1. A lock cylinder comprising:

a housing defining a cylindrical cavity, and an outer pin chamber communicating with the cavity, the outer pin chamber being adapted to house an outer pin;

a plug disposed in the cavity and being rotatable within the cavity between a locked position and an unlocked position, the plug having an inner pin chamber that is aligned with the outer pin chamber when the plug is in the locked position;

a key slot disposed at least partially through the plug, the key slot communicating with the inner pin chamber;

an inner pin housed in the inner pin chamber for movement along an axis, the inner pin being engageable with a key inserted into the key slot, the inner pin being engageable with the outer pin when the plug is in the locked position, and the inner pin including an outer surface having therein two non-axial grooves; and an engagement member that is supported by the plug and that extends into one of the grooves.

2. The lock cylinder of claim 1, wherein each of the non-axial grooves are spiral-like.

3. The lock cylinder of claim 2, wherein each of the non-axial grooves are helical.

4. The lock cylinder of claim 3, wherein at least one of the non-axial grooves defines an angle of incline of about 35 degrees with respect to a vertical axis of the inner pin.

5. The lock cylinder of claim 3, wherein each of the non-axial grooves has a curved surface defining a substantially semi-circular cross-section, and wherein the engagement member has a substantially semispherical end portion extending into the corresponding groove.

6. The lock cylinder of claim 1, wherein the housing and the plug define a shear line and the inner pin and the outer pin define a parting line, wherein the inner pin is moved to align the parting line with the shear line in response to an appropriate key inserted into the key slot, and wherein the inner pin is configured to rotate as the inner pin is moved in response to insertion of the appropriate key into the key slot.

7. The lock cylinder of claim 1, wherein the engagement member engaged with one of the non-axial grooves is configured to inhibit movement of the inner pin in response to the inner pin being bumped by an inappropriate key in the key slot.

8. The lock cylinder of claim 7, wherein the inner pin is inhibited from rotation in response to being bumped by the inappropriate key.

9. The lock cylinder of claim 1, wherein the engagement member is disposed within a bore of the plug, and wherein the bore is in communication with the inner pin chamber.

10. The lock cylinder of claim 9, wherein the bore is disposed substantially orthogonal to the inner pin chamber and orthogonal to the key slot.

11. The lock cylinder of claim 1, wherein the engagement member is removably disposed within the plug as a separate piece.

12. A lock cylinder comprising:

a housing defining a cylindrical cavity, and an outer pin chamber communicating with the cavity, the outer pin chamber being adapted to house an outer pin;

a plug disposed in the cavity, the plug rotatable within the cavity and including an inner pin chamber selectively aligned with the outer pin chamber;

a key slot disposed at least partially through the plug;

an inner pin disposed within the inner pin chamber, the inner pin including an outer surface having two non-axial grooves, each of the non-axial grooves having a curved surface defining a substantially semi-circular cross-section; and an engagement member disposed within the plug and having a substantially semispherical end portion extending into one of the non-axial grooves such that the semi-spherical end portion is substantially engaged with the curved surface to allow relatively slow movement of the inner pin, and to resist relatively quick movement of the inner pin.

13. The lock cylinder of claim 12, wherein the groove is spiral-like.

14. The lock cylinder of claim 12, wherein the groove is helical.

15. The lock cylinder of claim 12, wherein the non-axial groove defines an angle of incline of about 35 degrees with respect to a vertical axis of the inner pin.

16. The lock cylinder of claim 12, wherein the engagement member is configured to allow relatively slow movement of the inner pin in response to the inner pin being engaged by an appropriate key.

17. The lock cylinder of claim 12, wherein the engagement member is configured to resist relatively quick movement of the inner pin in response to the inner pin being bumped by an inappropriate key.

18. The lock cylinder of claim 12, wherein the engagement member is disposed within a bore of the plug, and wherein the bore is in communication with the inner pin chamber.

19. The lock cylinder of claim 18, wherein the bore is disposed substantially orthogonal to the inner pin chamber and orthogonal to the key slot.

20. The lock cylinder of claim 12, wherein the engagement member is removably disposed within the plug as a separate piece.

21. A method of operating a lock cylinder, the method comprising:

providing a lock cylinder including a housing defining a cylindrical cavity, and an outer pin chamber communicating with the cavity, the outer pin chamber housing an outer pin, a plug disposed in the cavity and being rotatable within the cavity between a locked position and an unlocked position, the plug having an inner pin chamber that is aligned with the outer pin chamber when the plug is in the locked position, a key slot disposed at least partially through the plug, the key slot communicating with the inner pin chamber, and an inner pin housed in the inner pin chamber, the inner pin including an outer surface having two non-axial grooves, each of the non-axial grooves having a curved surface defining a substantially semi-circular cross-section, the inner pin being engageable with a key inserted into the key slot, and the inner pin being engageable with the outer pin when the plug is in the locked position;

engaging the inner pin with an engagement member having a substantially semispherical end portion by extending the substantially semispherical end portion into one of the non-axial grooves and engaging the semispherical end portion with the corresponding curved surface;

allowing relatively slow movement of the inner pin in the direction toward the outer pin; and resisting relatively quick movement of the inner pin in the direction toward the outer pin.

22. The method of claim 21, wherein providing the inner pin with the non-axial grooves includes providing spiral-like grooves.

23. The method of claim 22, wherein providing the inner pin with the non-axial grooves includes providing helical grooves.

24. The method of claim 23, wherein providing the inner pin with the non-axial grooves includes providing at least one of the grooves with an angle of incline of about 35 degrees with respect to a vertical axis of the inner pin.

25. The method of claim 22, wherein providing the inner pin with the non-axial grooves includes providing the inner pin with an outer surface portion defining the spiral-like grooves, and wherein allowing relatively slow movement of the inner pin and resisting relatively quick movement of the inner pin also include engaging the engagement member with the outer surface portion of one of the non-axial grooves.

26. The method of claim 25, wherein providing the inner pin with the non-axial grooves includes providing the outer surface portion of the inner pin with groove defining portions generally facing in the direction toward the outer pin, and wherein allowing relatively slow movement of the inner pin and resisting relatively quick movement of the inner pin also include engaging the engagement member with one of the groove defining portions.

27. The method of claim 21, wherein allowing relatively slow movement of the inner pin and resisting relatively quick movement of the inner pin include rotating the inner pin.

* * * * *